US009204727B2

(12) United States Patent
Sprinkle

(10) Patent No.: US 9,204,727 B2
(45) Date of Patent: Dec. 8, 2015

(54) STADIUM SEAT MEMORABILIA SUPPORT BASE

(71) Applicant: Daniel Sprinkle, Rushville, IN (US)

(72) Inventor: Daniel Sprinkle, Rushville, IN (US)

( * ) Notice: Subject to any disclaimer, the term of this patent is extended or adjusted under 35 U.S.C. 154(b) by 14 days.

(21) Appl. No.: 14/054,163

(22) Filed: Oct. 15, 2013

(65) Prior Publication Data

US 2015/0054330 A1 Feb. 26, 2015

Related U.S. Application Data

(63) Continuation of application No. 13/971,323, filed on Aug. 20, 2013.

(51) Int. Cl.

| | |
|---|---|
| ***A47C 31/00*** | (2006.01) |
| ***A47C 7/00*** | (2006.01) |
| ***A47C 1/12*** | (2006.01) |
| ***A47C 11/00*** | (2006.01) |

(52) U.S. Cl.

CPC . *A47C 7/002* (2013.01); *A47C 1/12* (2013.01); *A47C 11/005* (2013.01)

(58) Field of Classification Search

CPC ..... A47C 4/02; A47C 7/002; A47C 7/56; A47C 7/62; A47C 1/12; A47C 11/005

USPC ..... 297/463.1, 463.2; 248/346.01, 346.03

See application file for complete search history.

(56) References Cited

U.S. PATENT DOCUMENTS

| | | | | | |
|---|---|---|---|---|---|
| 484,657 | A | * | 10/1892 | Hammond | 248/501 |
| 5,333,825 | A | * | 8/1994 | Christensen | 248/188.2 |
| 5,419,062 | A | * | 5/1995 | Polinski et al. | 40/124.4 |
| 5,513,900 | A | * | 5/1996 | Iglesias | 297/463.1 |
| 6,016,910 | A | * | 1/2000 | Rodearmel | 206/315.9 |
| 7,681,847 | B2 | * | 3/2010 | Levin | 248/188.2 |
| D617,585 | S | * | 6/2010 | Sprinkle | D6/495 |
| D645,279 | S | * | 9/2011 | Sprinkle | D6/495 |
| D661,924 | S | * | 6/2012 | Sprinkle | D6/495 |
| 2005/0072892 | A1 | * | 4/2005 | Fell | 248/441.1 |

OTHER PUBLICATIONS

Ball Park Seats, www.ballparkseats.com/Fenway/Fenway.htm, accessed Nov. 5, 2014, available Sep. 9, 2011 based on archive.org.*

* cited by examiner

*Primary Examiner* — Philip Gabler

(74) *Attorney, Agent, or Firm* — C. John Brannon; Brannon Sowers & Cracraft PC

(57) ABSTRACT

A method for enhancing sales of stadium seat memorabilia by utilizing a stabilizing base, with a large surface area in the shape of sports memorabilia, such as baseball bats and/or sports figures, with or without brackets, to mount and stabilize a stadium seat for use outside of the stadium, such as at home or in a commercial setting.

1 Claim, 7 Drawing Sheets

STADIUM SEAT MEMORABILIA SUPPORT BASE

CROSS-REFERENCE TO RELATED APPLICATIONS

This patent application is a continuation of co-pending U.S. patent application Ser. No. 13/971,323, filed on Aug. 20, 2013.

TECHNICAL FIELD

The present novel technology relates to furniture, and more particularly, a method and apparatus for stabilizing stadium seating for freestanding use.

BACKGROUND

Stadium seats that were once part of famous arenas around the country, such as Old Busch Stadium, are now highly sought after sports memorabilia by sports enthusiasts and/or collectors that wish to own a piece of sports history. Typically, while in use, stadium seats are mounted directly onto the rise of the step behind the seat through a vertical bracket, or are mounted directly onto a horizontal surface, such as by bolting the two spaced apart vertically extending up-stands to the concrete step floor. When removed from a stadium or sports arena, a stadium seat is typically not able to stand on its own as there is no base or stand affixed to the chairs themselves. In other words, most stadium seats only have two legs. Currently, individuals are not able to mount stadium seats previously utilized in sports arenas without the use of a pair of ski-like stabilizing base members mounted to each respective leg. While effective in minimizing side-to-side rocking and providing a minimal modicum of stability to the seats, these ski-like mounting 'feet' still allow a degree of front-to-back rocking and do little to enhance the appearance of the seats or to compliment the sports experience. Thus, there is a need for an improved stabilizing base for retired stadium seats that has an extended surface area and which increases marketing value through the use of customization and personalization. The present novel technology addresses this need.

DESCRIPTION OF THE PREFERRED EMBODIMENTS

Figure 1:
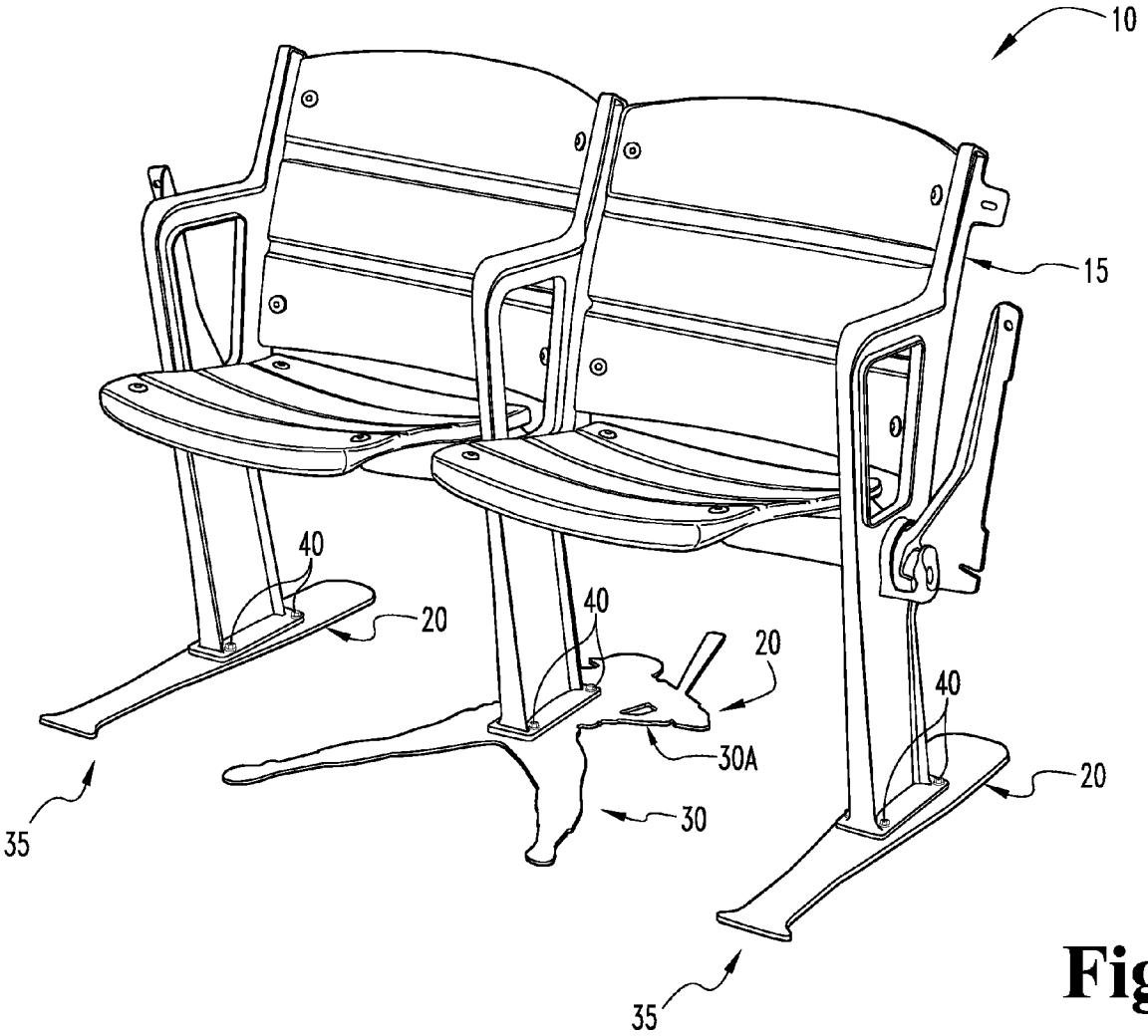
FIG. 1 is a front perspective view of a stadium seat support base according to a first embodiment of the present novel technology.

For the purposes of promoting an understanding of the principles of the novel technology and presenting its currently understood best mode of operation, reference will now be made to the embodiments illustrated in the drawings and specific language will be used to describe the same. It will nevertheless be understood that no limitation of the scope of the novel technology is thereby intended, with such alterations and further modifications in the illustrated device and such further applications of the principles of the novel technology as illustrated therein being contemplated as would normally occur to one skilled in the art to which the novel technology relates.

To provide increased stability and to enhance sales for stadium memorabilia seats, the present novel technology relates to a system 10 for stabilizing and supporting stadium seats, referred to herein as 15 and/or 18, once utilized in a sports arena, such as a professional football stadium, so the seats 15 can then be used as a conventional stand-alone seat and repositioned as a normal chair without having to be permanently mounted to a floor or other surface. In essence, the system 10 converts a piece of sports memorabilia (the stadium seat with no mount) that would be inoperable outside of a sports arena into a useful article (a chair that can be used outside of a stadium). In addition, the system 10 provides a method for enhancing the appearance and utility of retired stadium seats through unique design features that add to the sport memorabilia aspect of the stadium seat while also providing enhanced stabilization due to a stabilizing base, referred to herein as 20 and/or 25, with coverage of a greater surface area.

Figure 2:
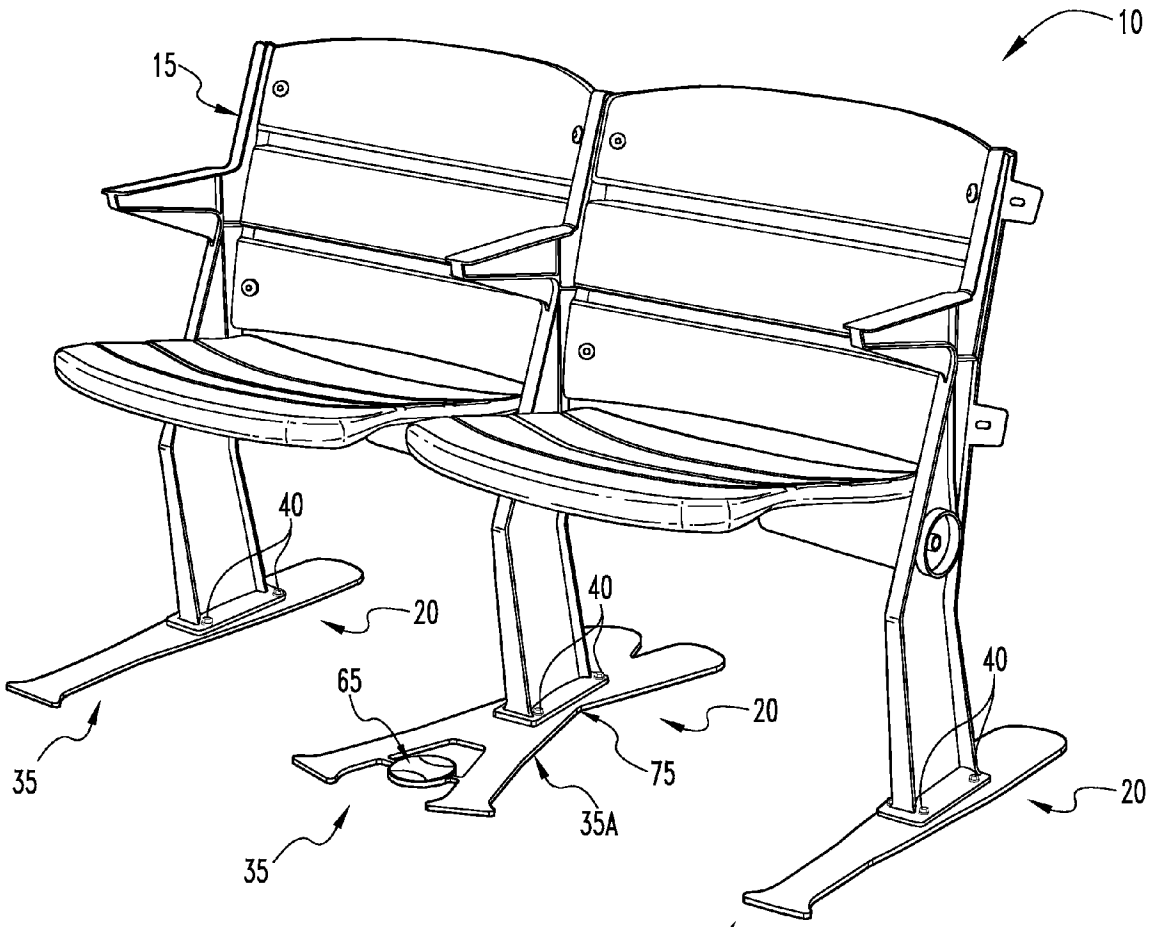
FIG. 2 is a front perspective view of a stadium seat support base according to a second embodiment of the present novel technology.

FIGS. 1-2 and FIGS. 4-5 illustrate a first embodiment of the present novel technology, a stadium seat support base 10 for use with individual seats 15 and/or multi-occupant benches 15 originally mounted to a vertical or horizontal stadium step-riser surface, wherein the system 10 includes a stabilizing base 20, generally shaped to resemble an article of sports memorabilia and/or equipment, such as the outline, shape, or silhouette of a sports FIG. 30 and/or 33 (such as a baseball player 30A, as illustrated in FIG. 1), the outline, shape, or silhouette of sports equipment 35 and/or 34 (such as intersecting baseball bats 35A and/or 33A, as illustrated in FIG. 2), the outline, shape, or silhouette of a mascot, the outline, shape, or silhouette of a cheerleader, the outline, shape, or silhouette of a team logo, a combination thereof, or the like. The stadium memorabilia system 10 may consist of a stabilizing base 20 wherein the stadium seat 15 mounts directly onto the stabilizing base through the use of existing hardware, or may consist of a stabilizing base 25 designed to accept a bracket operationally connecting the stadium seat 18 with the stabilizing base 25. The stabilizing base 25 may include a bracket system 44 designed to convert the stabilizing base 25 into the appropriate configuration for use with a variety of stadium seats 18. Additionally, the stadium memorabilia system 10 may be a kit comprising of at least one memorabilia support base for each leg of the stadium-mounted seat, fasteners sized and adapted for securing the support base and/or sized and adapted to accept a mounting bracket.

The stabilizing base 20, which receives and securely mounts to the stadium seat 15, is typically made out of wood or metal, although any convenient structural material may be selected, and is of sufficient surface area to stabilize and hold the weight of the stadium seat 15 with the addition of body weight thereon. Typically, the base 20 is made of ¼", ⅛", 3⁄16", or the like, thick steel. Specifically, the stabilizing base 20 spans at least about 30% of the surface area under a stadium seat 15, more typically at least about 25% of the surface area under a stadium seat 15, and more typically at least about 15% of the surface area under a stadium seat 15. The span of the stabilizing base 20 underneath the stadium seat 15 provides for greater surface area stabilization compared to conventional methods for chair support. Additionally, stadium seats 15 are not inherently well balanced, as they are designed to be bolted down in normal use. Independent balance and support are not important stadium seat 15 design considerations since the seats are normally not designed to be free standing. By design, stadium seats 15 commonly only have at most two points of contact with their support surface and cannot stand on their own, in contrast to a traditional chair that typically has four points of contact. Without a stabilizing base 20 that covers a sufficient area under the stadium seat 15, a stadium seat 15 standing alone would simply topple over.

In one embodiment, there is a cross-connection of two elongated members 35A and/or 33A wherein each stadium seat leg may be connected to a single enlarged support base 20 and/or 25 rather than a respective separate support member. For example, the stabilizing base 20 and/or 25 comprises two intersecting portions 35A and/or 33A having the shapes of baseball bats angularly oriented relative to each other and connected between each other via a central portion 75 and/or 76 of the stabilizing base 20 and/or 25. The width of the elongated members 35A and/or 33A of the stabilizing base 20 and/or 25 is typically not less than about 3 inches and more typically not less than about 5 inches. The large surface area covered by the stabilizing base 20 and/or 25, the width of the intersecting elongated members 35A and/or 33A, and the enhanced stability provided by the criss-cross or x-shaped design (in some embodiments), provides desired stabilization and robustness of the stadium memorabilia support base system 10.

A plurality of bolt holes 40, typically centrally positioned, extend through the stabilizing base 20 in a typically rectangular pattern, more typically evenly circumferentially spaced to accept the base brackets of the original stadium seat 15 therein. The bolt holes 40 are typically oriented in a pattern matching that characteristic of the stadium seats 15 from a given source. The plurality of bolt holes 40 located within the stabilizing base 20 are typically countersunk to prevent bolts and/or screws connecting the base 20 to a seat 15 from marring the floor when the seat is in use. In addition, the stabilizing base 20 typically contains a plurality of non-slip positioning pads 50 positioned on the bottom surface, each pad having a coefficient of friction suitable for preventing the stabilizing base 20 from slipping or sliding. The non-slip positioning pads 50 are generally fabricated from a material with superior grip characteristics, such as natural rubber or a polymer, although any like material may be used, and are generally rectangular in shape, although any appropriate shape may be selected. In some embodiments, the pods 50 have the silhouette shapes of athletic shoes.

Figure 3:
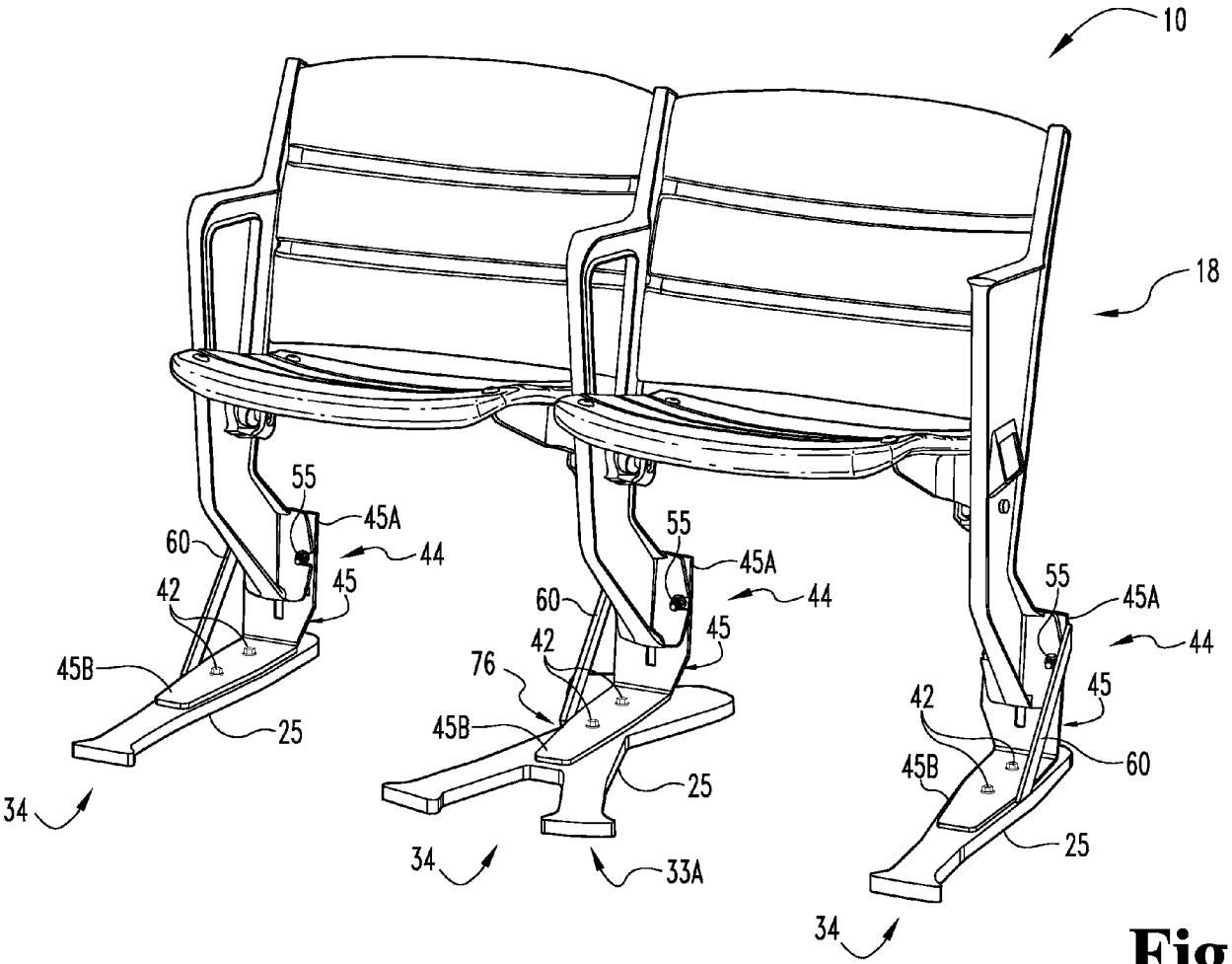
FIG. 3 is a front perspective view of a stadium seat support base according to a third embodiment of the present novel technology.
Figure 7:
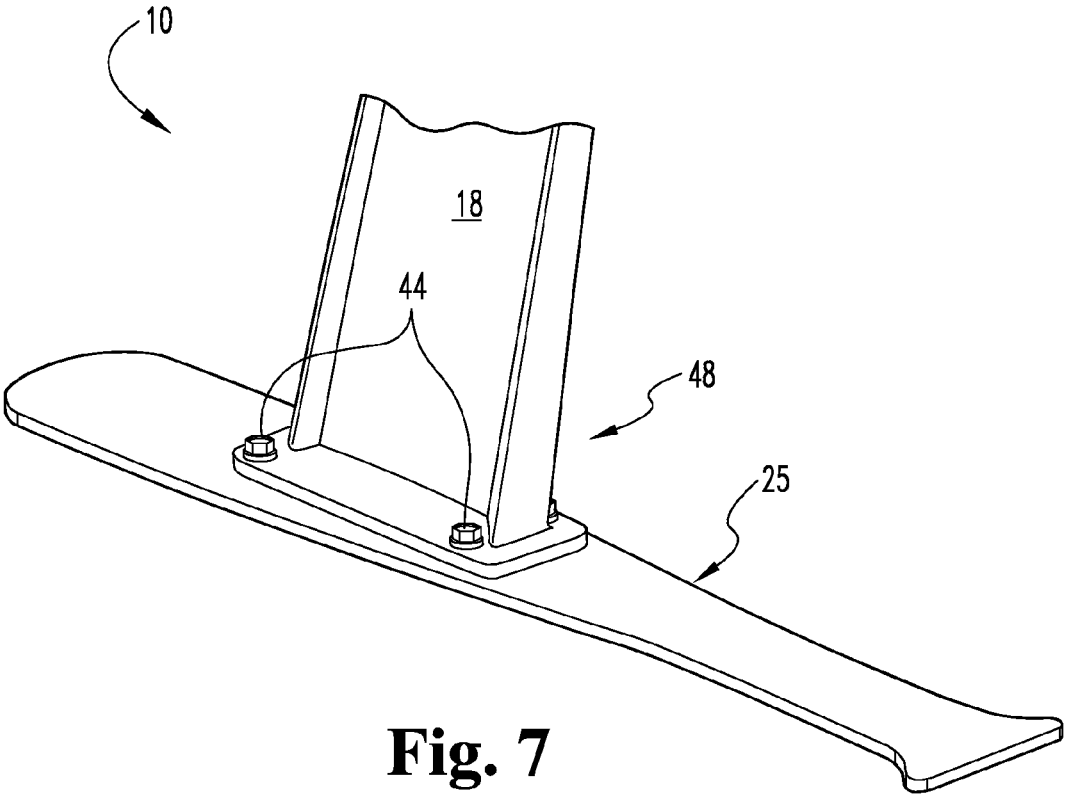
FIG. 7 is a side perspective view of a T-bracket utilized on the stadium seat support base according to a fifth embodiment of the present novel technology.

In another embodiment, as illustrated in FIGS. 3 and 7, the stadium memorabilia support base 10 is designed for use with seats and/or benches 18 originally mounted as "riser-mount" chairs. For example, chairs that may be mounted to the vertical rise of the step behind the stadium seat 18. These seats 18 are even less inherently stable than those designed to be bolted to a horizontal surface. In addition to the characteristics of the prior embodiments of the stadium memorabilia support base 10 as described above, this embodiment base 25 generally includes a bracket system 44 that embodies various shapes and mounting bolt locations to receive various forms of stadium seat 18 legs. In one embodiment, as illustrated in FIG. 3, the stabilizing base 25 typically includes an additional L-shaped mounting bracket 45 that permits the perpendicularly located mounting bolts 55 of the original stadium seat/bench 18 to connect with the horizontally aligned stabilizing base 25 and plurality of horizontally aligned bolt holes 42 located therein. The bracket 45 is generally made out of metal, although any similar material may be used, and typically contains two orthogonally disposed intersecting members 45A and 45B defining the "L" shape. One of the orthogonally disposed side members 45A extends vertically, and contains a plurality of holes 42 to receive the perpendicularly located mounting bolts 55 of the original stadium seat/bench 18. The other orthogonally disposed side member 45B extends horizontally and likewise contains a plurality of holes 42 for mounting the bracket 45 on the stabilizing base 25 through the plurality of bolt holes 42 located on the stabilizing base 25. In addition, a support strut 60, generally made of the same structural material as the bracket 45, typically extends diagonally from the member 45A to the member base 45B, connecting the two members 45A and 45B at either end. In an alternative embodiment, as illustrated in FIG. 7, the bracket system 44 of the stabilizing base 25 may be T-shaped 48, wherein the stadium seat 18 chair leg is mounted near the center of the stabilizing base 25 through a plurality of bolt holes 44 designed to accept a stadium seat 18 chair leg located on the stabilizing base 25, although any conveniently shaped bracket may be utilized.

Figure 4:
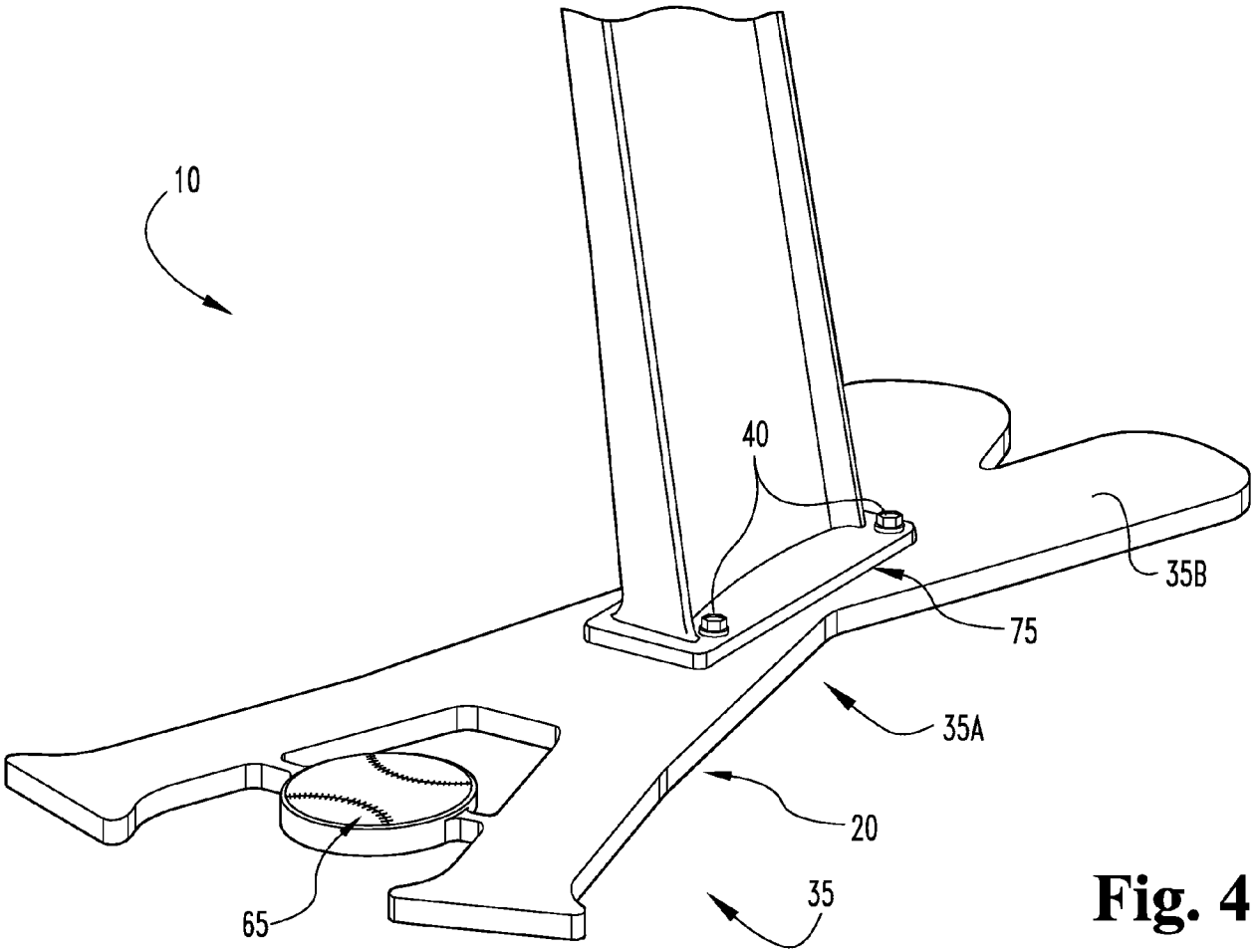
FIG. 4 is a front perspective view of the third embodiment illustrating a removable personalized plaque.
Figure 5:
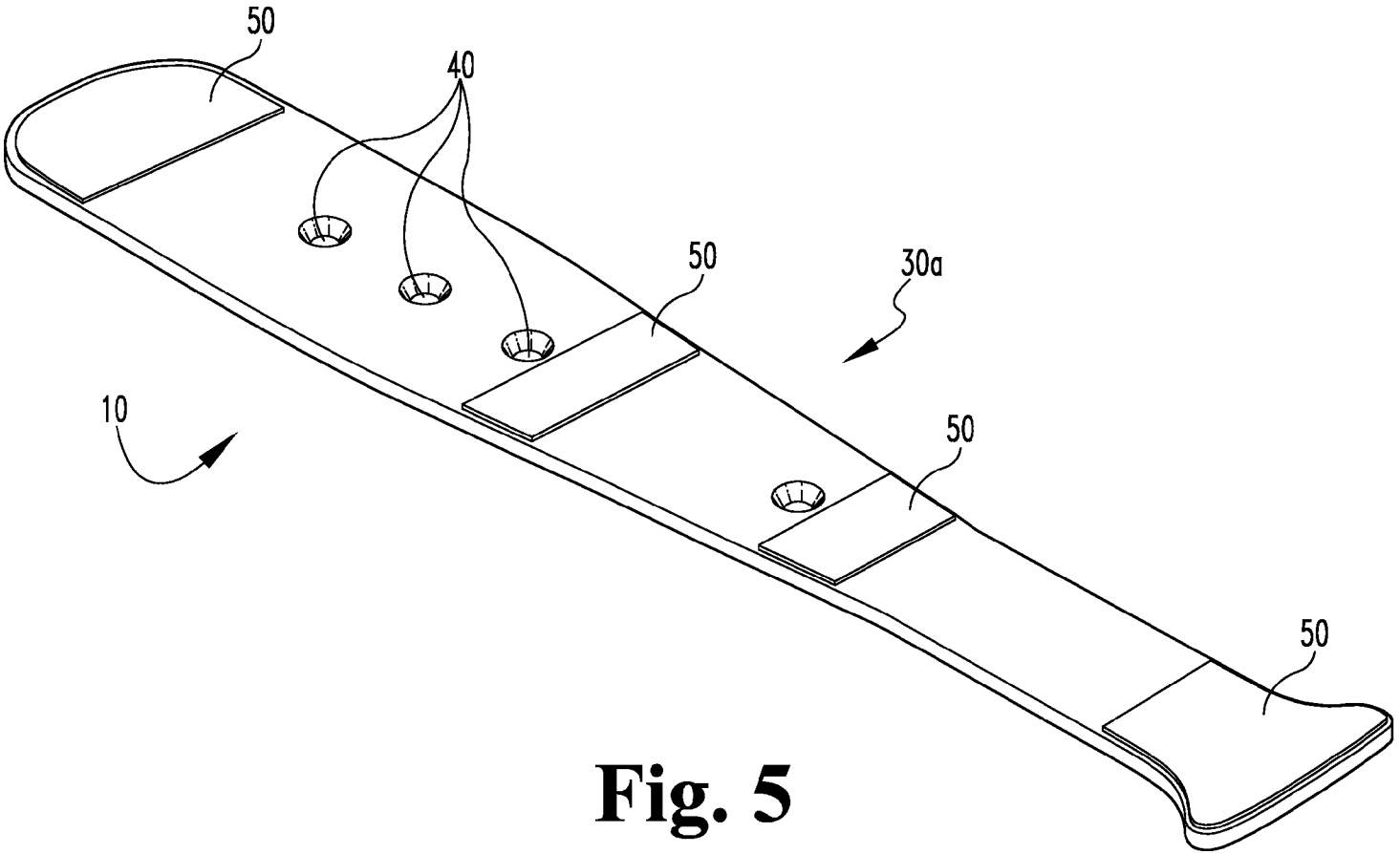
FIG. 5 is a front perspective view of the bottom of a stadium seat support base according to the second embodiment of the present novel technology.

As illustrated in FIGS. 2 and 4, a personalized name plate 65 may be removably secured or permanently engraved on the stabilizing base 20. The name plate 65 is typically made of a decorative metal, although any convenient material may be selected. The name plate may be in any size or shape, and may be located anywhere convenient on the stabilizing base 20.

To enhance the marketing value of the stadium memorabilia support system 10, the stabilizing base 20 as well as the personalized name plate 65 may be painted or embossed and personalized. For example, in the embodiment wherein a sports FIG. 30 is utilized as the supporting base 20, the sports FIG. 30 may be painted or personalized to represent a specific player, a specific team, or personalized even further to represent the purchaser, such as the purchasers name and preferred number on a jersey of their favorite team. In addition, the personalized name plate 65 may be painted or embossed to represent a particular game, a particular team, or other information that the purchaser wishes to memorialize with the stadium memorabilia support base 10.

Figure 6:
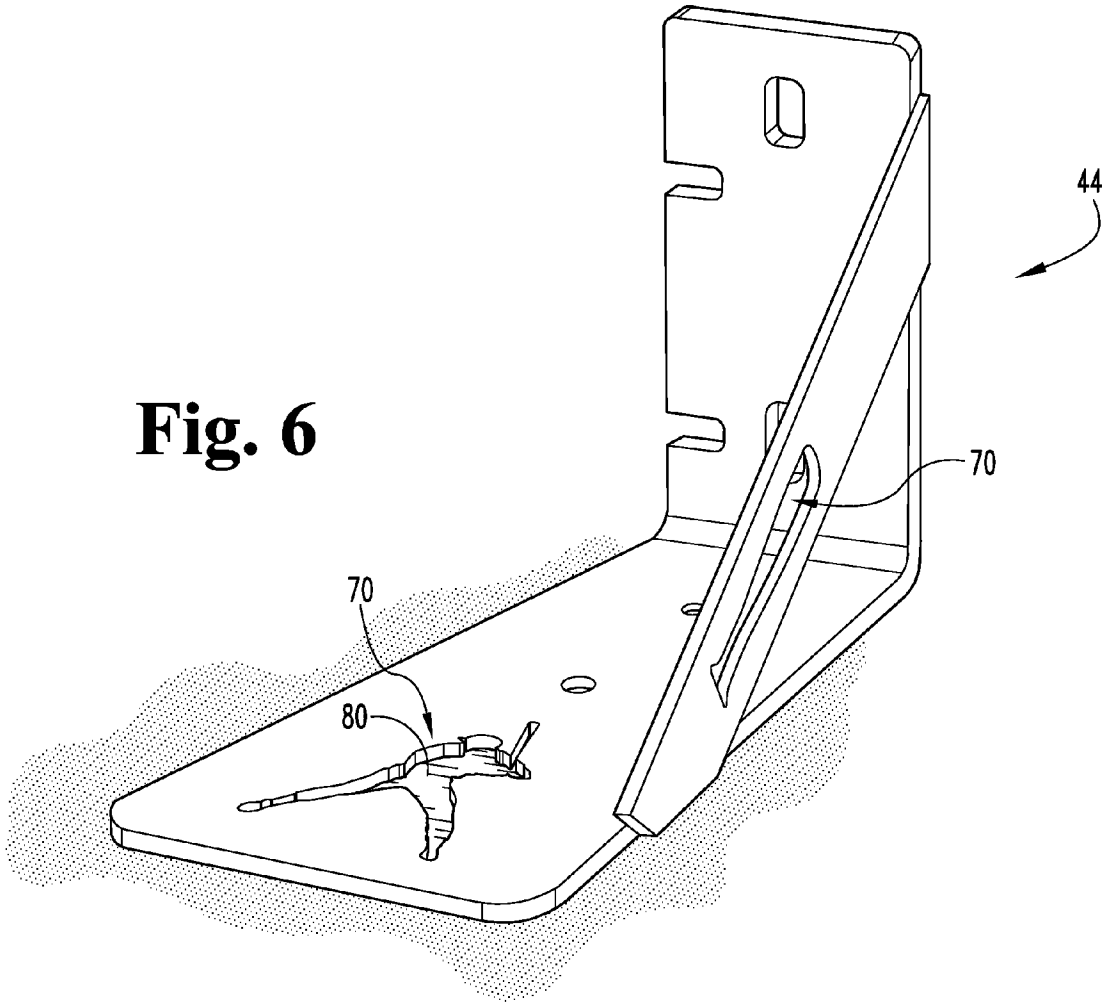
FIG. 6 is a side perspective view of an L-bracket utilized on the stadium seat support base according to a fourth embodiment of the present novel technology.

In another embodiment, as illustrated in FIG. 6, silhouettes 70 of sports memorabilia 35, sports FIG. 30, writing, or the like, may be cut from the L-shaped bracket 45, such as from one or more of the horizontal base members 45A, 45B and/or 60, or any convenient location on the L-shaped bracket 45, as well as any convenient location on the stadium memorabilia support system 10. The cut-out silhouette 70, produced through the use of a laser, waterjet, or the like, may be filled or backed with interchangeable color panels 80 consisting of various colors located on the reverse side of the cut-out silhouette 70. The panels 80 may be bright acrylic, glow-in-the-dark materials, illuminated panels, or the like, although any convenient material may be selected to make the silhouette stand-out. In addition, translucent materials may be used so that light shines through the colored panel and cut-out silhouette 70, whether the light be natural light or light emitting from an energized lighting source. The cut-out silhouette 70 may be personalized to add attractiveness and value to sports enthusiasts, including but not limited to: team colors, including a multi-color light to use numerous colors within one cut-out silhouette, team or individual's names, information that the sports enthusiasts wishes to portray, and the like.

While the novel technology has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the novel technology are desired to be protected.

What is claimed is:

1. A method for mounting and stabilizing stadium seats removed from a stadium, comprising:

aligning a first pattern of bolt holes on a stadium seat with a second pattern of bolt holes on a stabilizing base generally shaped to resemble an article of sports memorabilia;

attaching the stabilizing base to the stadium seat to define a stand-alone assembly; and positioning the stand-alone assembly on a flat surface to define an under-seat area;

wherein the stabilizing base has a base surface area of between 15% and 30% of the under seat area;

wherein the stabilizing base is the silhouette of a sports figure, the outline of sports equipment, a combination thereof, or the like; and wherein the stabilizing base generally features a cut-out silhouette of a sports article.

* * * * *